United States Patent [19]

Juteau

[11] Patent Number: 4,978,006

[45] Date of Patent: Dec. 18, 1990

[54] PORTABLE REGISTER BOX

[75] Inventor: Olivier D. Juteau, Bouqival, France

[73] Assignee: Moore Business Forms, Inc., Grand Island, N.Y.

[21] Appl. No.: 396,695

[22] Filed: Aug. 22, 1989

[30] Foreign Application Priority Data

Sep. 30, 1988 [FR] France ..... 88 12798

[51] Int. Cl.[5] ..... B65D 85/67

[52] U.S. Cl. ..... 206/449; 206/494; 206/232

[58] Field of Search ..... 206/232, 449, 555, 451, 206/494, 37

[56] References Cited

U.S. PATENT DOCUMENTS

| | | | |
|---|---|---|---|
| 1,770,021 | 7/1930 | Walsh et al. . | |
| 2,222,245 | 11/1940 | Steen | 206/449 |
| 3,186,542 | 6/1965 | Greene | 206/449 |
| 4,681,226 | 7/1987 | Pretre . | |
| 4,735,317 | 4/1988 | Sussman et al. | 206/449 |

FOREIGN PATENT DOCUMENTS

| | | |
|---|---|---|
| 1248926 | 1/1989 | Canada . |
| 919296 | 3/1947 | France . |
| 971804 | 1/1951 | France . |
| 1018339 | 1/1953 | France . |

*Primary Examiner*—Joseph Man-Fu Moy
*Attorney, Agent, or Firm*—Nixon & Vanderhye

[57] ABSTRACT

The invention relates to a portable register box.

The box comprises a bottom (1) and a cover (4) having a recess (5) through which it is possible to write on a paper sheet supported by a rigid plate 8, a compartment (14) being provided on this plate for a reserve of blank paper. In the bottom 1 there is provided a cutout (7), via which it is possible to introduce a paper sheet into a filing compartment (15) separated or not from the blank-paper compartment. The user can thus store the duplicates made when using a duplicating paper. The box can be of cardboard. It can form a means of permanent filing.

9 Claims, 5 Drawing Sheets

FIG. 3
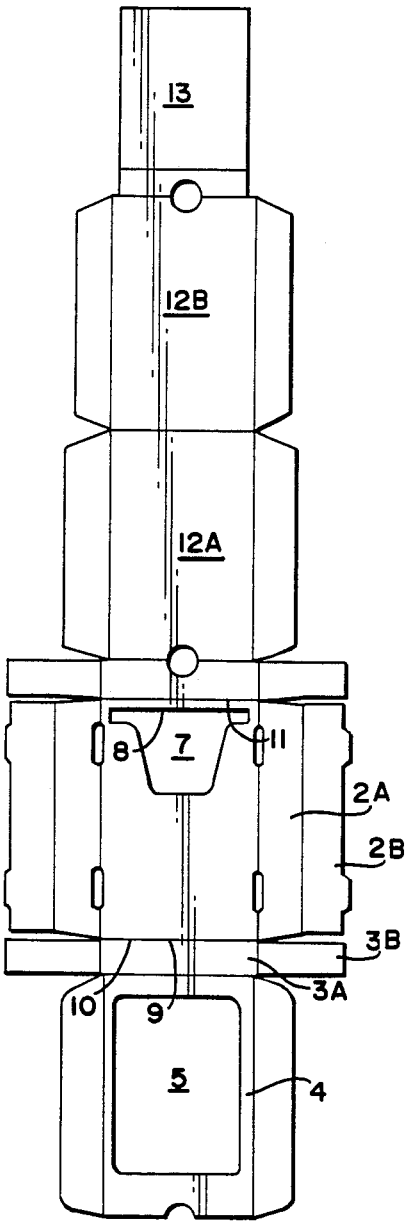
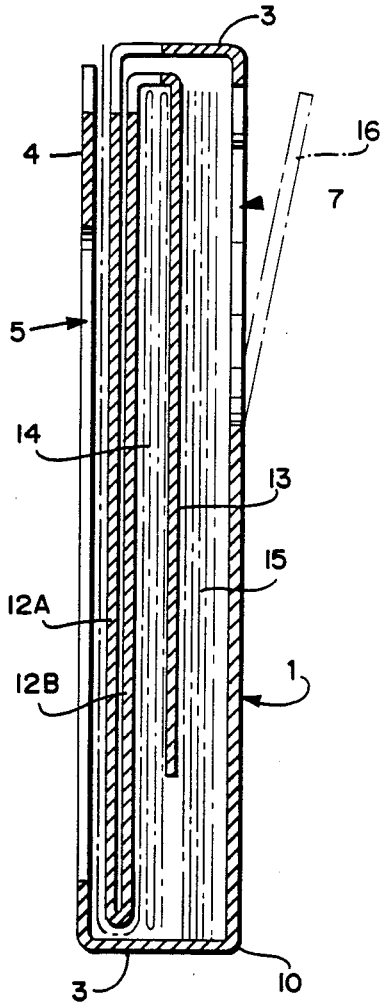
FIG. 4

PORTABLE REGISTER BOX

The present invention relates to a portable register box.

There are known portable register boxes comprising a bottom, two lateral sides, two transverse sides and a recessed cover making it possible to see a paper located inside the box and write on it, this paper being dischargeable via a slot arranged at the end of the cover, the box also being equipped with a rigid plate serving as a writing table located between the recessed cover and the inner volume of the box, the said rigid plate leaving, on the opposite side to the slot, a passage which allows part of a paper strip contained in the inner volume to pass over the said plate so that it is possible to write on it.

Where invoices or similar documents are concerned, the paper is a self-copying paper or one provided with a carbon, and a duplicate is made when it is written on. This duplicate, usually kept by the person who has written on the box, must be preserved. It is normally stored separately. When the user, for example in a local trade, does not have room for storing the duplicates, he puts them in his pocket or in a bag where they risk being damaged or crumpled. It is then necessary to reclassify them, and this takes time.

The object of the present invention is to solve these problems and provide a portable register box which allows a systematic filing of the documents produced.

To achieve this result, the invention provides a portable register box comprising a bottom, two lateral sides, two transverse sides and a recessed cover making it possible to see a paper located inside the box and write on it, this paper being dischargeable via a slot arranged at the end of the cover, the box also being equipped with a rigid plate serving as a writing table located between the recessed cover and the inner volume of the box, the said rigid plate leaving, on the opposite side to the slot, a passage which allows part of a paper strip contained in the inner volume to pass over the said plate so that it is possible to write on it, its particular feature being that the bottom of the box has a cutout, via which it is possible to introduce into the inner volume a paper sheet intended to be filed there. Thus, the documents produced or rather the duplicates can be filed immediately, without risk of loss, damage or disorder.

The register box can be designed not to be reloaded after its initial content of paper has been exhausted. It can also be designed for long-term use with successive reloadings of the inner volume of the box when it is empty. In this case, it is sufficient if periodically, for example at the end of the day, the bottom of the box is opened in order to recover the filed documents. Because the volume of the documents to be filed is only a fraction of that of the blank paper which has been used, since the original is returned to the customer each time, there is no problem in providing sufficient space for the duplicates to be filed.

There was a proposal, particularly in the Patent Application No. FR-A-2,575,442, published on July 4, 1986, to produce the register box by the cutting out and folding of a single cardboard blank, at least with regard to the bottom, cover and sides. The low cost price of this box makes it possible to discard it, after its content has been used, without reloading it.

Instead of obtaining the box from a single blank, it is also possible for it to be obtained by assembling together two elements, each obtained from a single blank of foldable material, a first element comprising the recessed cover and a second element comprising the rigid plate.

When the register box, whether it is made of cardboard, plastic or any other material, is not intended to be reloaded after its initial content of paper has been exhausted, the invention affords a considerable advantage because it makes it possible to produce this register box as a "final" filing box, where the documents will be stored for the entire period for which it is necessary to preserve them.

According to an especially expedient embodiment, the register box can contain a movable partition dividing the inner space into two compartments intended respectively for the strip of blank paper and for the filed documents.

The invention will now be described in more detail by means of practical examples illustrated in the drawings in which:

FIG. 3 is a view of a cardboard blank making it possible to obtain a register box according to FIGS. 1 and 2.

FIG. 4 is a sectional view of the box of FIGS. 1 and 2 on a larger scale and in a mid-plane.

The box described with reference to FIGS. 1 to 4 forms, as a whole, an alternative version of the box which is the subject of the Patent No. FR-A-2,575,442 already mentioned, to which express reference is made for the details not given here. It will be recalled that this document describes a register box obtained by the cutting out and folding of a single cardboard blank, its particular feature being that the rigid plate is formed by a bent part of the blank connected to the rest of the latter by means of a folding line located opposite that connecting the cover to the rest of the blank, and that the discharge slot for the paper is located at the free end of the cover.

Figure 1:
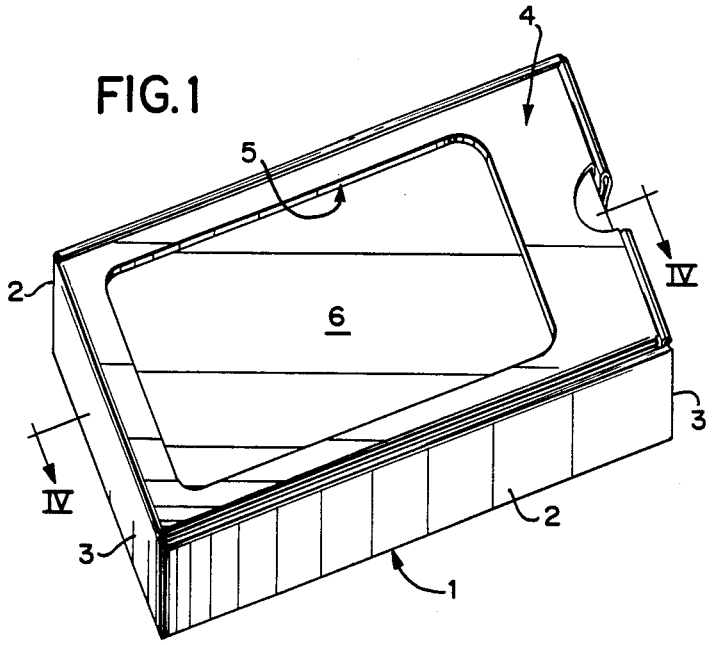
FIGS. 1 and 2 are respectively top and bottom perspective views of a register box according to the invention.
Figure 2:
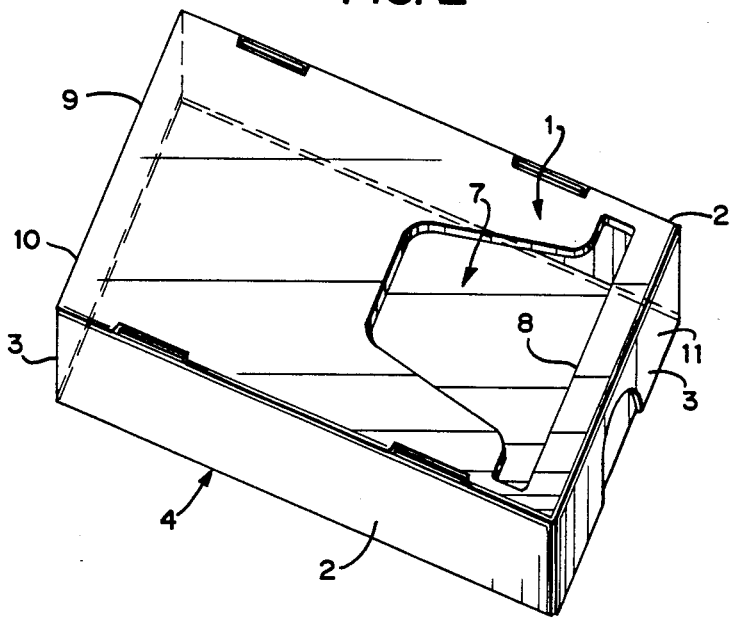

FIGS. 1 and 2 show the bottom 1 of the box, its lateral sides 2, its transverse sides 3 and its cover 4 having a window 5 making it possible to see a paper 6 and write on it.

The essential difference between the register box of the abovementioned document and that described here is an aperture 7 provided in the bottom. This aperture of approximately triangular general form comprises a transverse margin 8, of length substantially equal to the inner width of the box and located at a short distance from that edge 9 of the box which is nearest to the discharge slot for the paper, and a peak 10 adjacent to the middle of the bottom 1. The result of this is that it is possible to file in the box documents of a size comparable to that of the bottom 1.

FIG. 3 shows the blank which has served for making the box illustrated in FIGS. 1 and 2.

In this Figure, the panels bear the same references as the parts of the register box which they are to form: the panels 1 and 4 are intended for forming the bottom 1 and the cover 4, the panels 2A and 2B, after folding, form the lateral sides 2, and the panels 3A and 3B the transverse sides 3. The bent panels 12A and 12B form the rigid plate 12.

The blank possesses, in comparison with that of FR-A-2,575,442, an additional panel 13 which extends the panel 8B, being narrower than this. This additional panel forms, after assembly, a movable partition 13 (FIG. 4) which separates the blank-paper compartment 14 from the filing compartment 15. This panel is optional. In fact, it has been found that, during normal use, the risk of seeing a filed document being carried along by the strip of blank paper until it appears in the window 5, with the panel 13 absent, is only very slight. Moreover, the friction of the blank strip on the filed documents inside the box tends to move them away from the edge 8 of the aperture 7 and prevent them from coming out. This would not be true if the aperture 7 were located near the opposite edge 11 of the bottom.

It will be seen that, in FIG. 4, it is assumed that the bottom surface corresponding to the aperture 7 is not removed completely, but forms a flap 16 which remains fastened to the box along the edge 10, so as to prevent the filed documents from escaping and provide some protection for them by closing off the aperture 7 at least partially. This embodiment is not obligatory.

FIGS. 5 to 10 relate to alternative versions of the box according to the invention, in which the box is obtained by assembling together two elements which can each be obtained by the cutting out and folding and, if appropriate, adhesive bonding of a blank of foldable material, such as cardboard.

Figure 5:
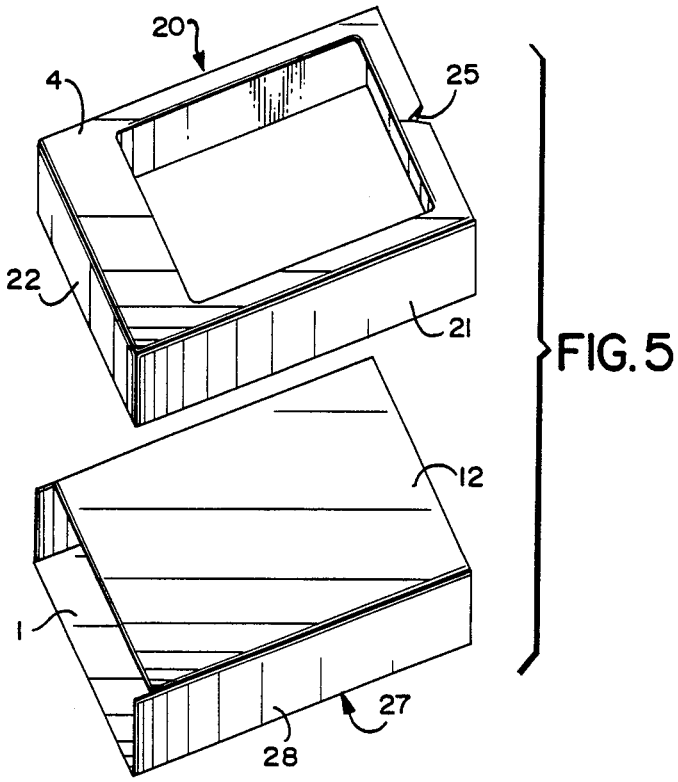
FIGS. 5 and 6 are exploded perspective views of an alternative box according to the invention.
Figure 6:
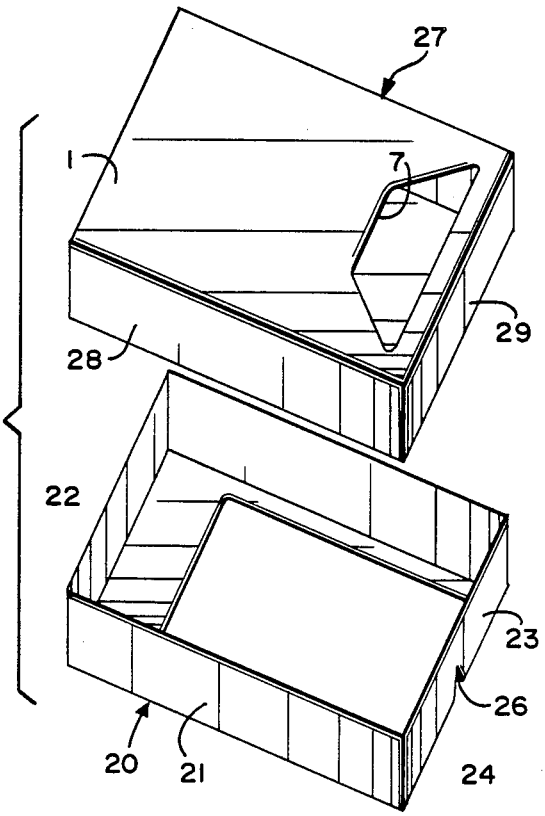

FIGS. 5 and 6 show a box, of which the first element 20 comprises the cover 4, two identical outer lateral sides 21 and two transverse sides 22, 23. A paper discharge slot is provided at the location of the edge connecting the cover 4 to one of the transverse sides 23, and notches 25, 26 are provided on either side of this slot 24, one on the cover and the other on the transverse side 23, to allow the paper to be grasped (these notches are not always necessary).

The second element 27 comprises the bottom 1 with an aperture 7 similar to that seen in FIGS. 2 to 4, two inner lateral sides 28, an inner transverse side 29 and a rigid plate 12 opposite the bottom. On the opposite side to the transverse side 29, the rigid plate does not extend as far as the end of the lateral sides 28, but leaves a space which, once the box is assembled, will serve for passing the paper over the rigid plate 12 from the inner volume of the box.

Assembly is carried out by shifting the two elements perpendicularly relative to the plane of the cover and of the bottom, care being taken to make the transverse side 23 of the first element having the slot 24 coincide with the transverse side 29 of the second element. The two elements engage one into the other.

This results in a box of which the external appearance and method of use are essentially the same as described above.

Figure 7:
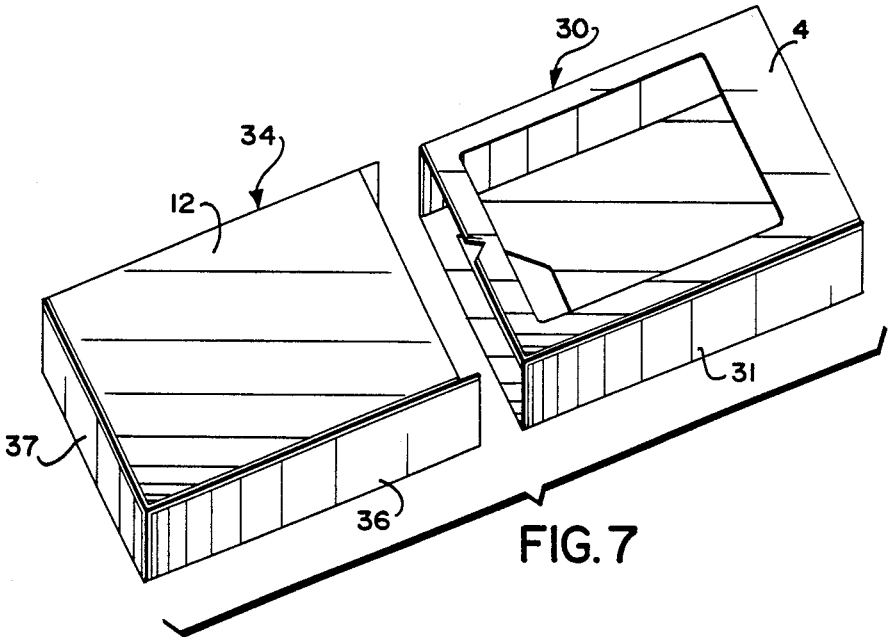
FIGS. 7 and 8 are similar views of another alternative version.
Figure 8:
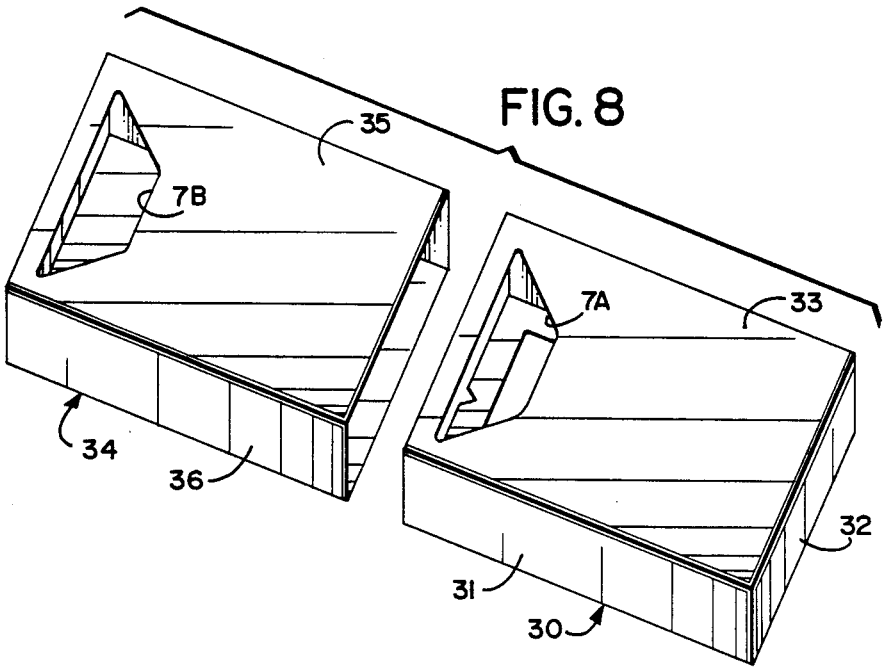

FIGS. 7 and 8 show another alternative version.

The first element 30 comprises a cover 4, two outer lateral sides 31, a transverse bottom 32 and an outer bottom 33 having an aperture 7A. The second element 34 comprises an outer bottom 35 having an aperture 7B superposable on the aperture 7A of the outer bottom of the first element, two inner lateral sides 36, a transverse side 37 and a rigid plate 12 which does not extend as far as the end of the inner lateral sides 36.

The unit is assembled by sliding the second element into the first in the manner of a matchbox, care being taken first to introduce that part of the second element not having a lateral side. During the operation, the apertures 7A and 7B come into coincidence with one another. The paper outlet slot is formed by the space present between the rigid plate 12 and the cover, and the paper coming from the inner space and covering the rigid plate 12 passes between the transverse side 32 and the set-back edge of the rigid plate 12.

Figure 9:
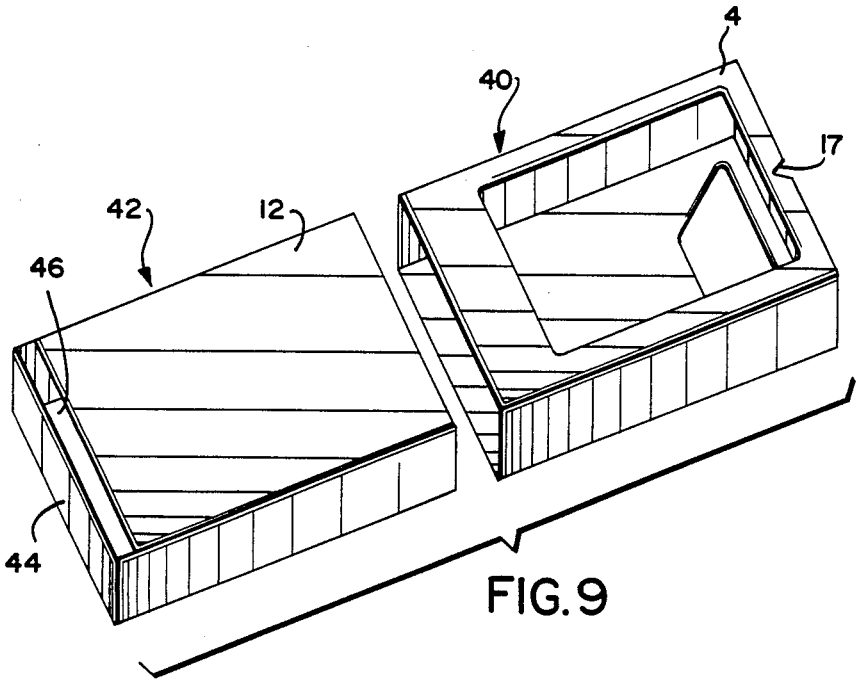
FIGS. 9 and 10 are further similar views of another alternative version.
Figure 10:
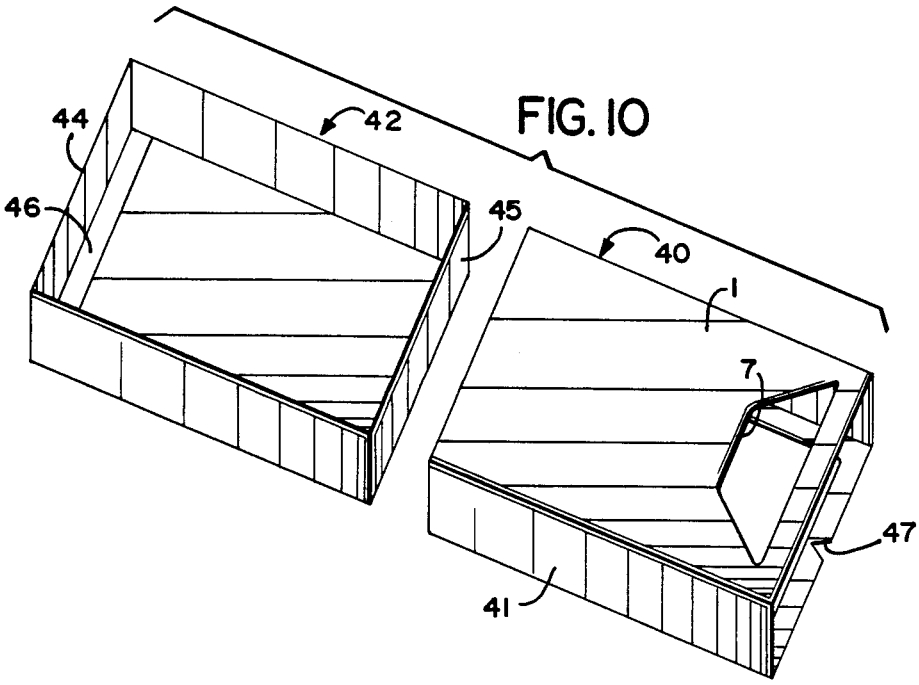

FIGS. 9 and 10 show a first element 40 comprising a cover 4, two outer lateral sides 41 and a bottom 1 with an aperture 7. It can also possess an outer transverse side, but not necessarily. The second element 42 comprises two inner lateral sides 43, two transverse sides 44, 45 and a rigid plate 12. The rigid plate 12 does not reach one of the lateral sides 44 and leaves a passage 46 for the paper coming from the inner space onto the said rigid plate.

Assembly is carried out by sliding the second element into the first, as in FIGS. 7 and 8. It is expedient if, in the assembled box, the passage 46 is opposite the notch 47 provided in the cover for pulling the paper.

I claim:

1. A portable register box comprising:

a bottom, two lateral sides, two transversely extending sides and a cover having an opening therethrough for viewing and enabling writing on a paper strip located inside the box;

means defining a discharge slot disposed at an end of the cover adjacent a transverse side of said box;

a substantially rigid plate within said box serving as a writing table located between the cover and the inner volume of the box whereby paper strip overlying the plate may be written on through said opening and paper strip stored in said inner volume, said plate extending toward the transverse side opposite said slot and leaving a passage between said opposite transverse side and an edge thereof to enable part of a paper strip contained in the inner volume to pass therefrom, about said edge, and over the plate into a writing position overlying said plate below said opening, said bottom of said box having a cutout defining an aperture for receiving discrete paper sheets into the inner volume of said box for filing therein with the paper strips in said inner volume.

2. A register box according to claim 1 wherein said box is formed of a single blank of foldable material.

3. A register box according to claim 2 wherein said cover is connected to said blank by a foldline adjacent said opposite transverse side of said box and extends therefrom to terminate in a free end, said plate being formed by a bent portion of said blank connected thereto by a folding therealong located opposite the foldline connecting the cover to said blank, said discharge slot for the paper being located adjacent the free end of said cover.

4. A register box according to claim 1 including a partition dividing the inner space into two compartments disposed between said plate and said partition and between said partition and said bottom for receiving paper sheets and filed paper sheets, respectively.

5. A register box according to claim 1 wherein said cutout has a movable flap for preventing the filed paper sheets from being discharged from the box.

6. A register box according to claim 1 wherein said box is formed of two discrete elements assembled one with the other, each element being obtained from a single blank of foldable material, one of said elements including the cover and the other of said elements including said rigid plate.

7. A register box according to claim 6 wherein the first element comprises a box having a pair of side walls, a pair of transverse side walls and a slot at the junction of the cover and one of the transverse side walls, said second element forming a box comprising a bottom and being open adjacent said opposite transverse side wall of said first element in the assembly of said first and second elements, said boxes being assembled one to the other with said second element being received within said first element in a direction perpendicular to the cover and bottom.

8. A register box according to claim 6 wherein the first element forms a box open on the paper discharge side thereof, and the second element forms a box open only on the opposite side to the paper discharge side, each said element having an aperture through its bottom superposable in assembly of said elements to form said cutout, said elements being assembled by sliding the second element into said first element in a direction parallel to the lateral sides of said box.

9. A register box according to claim 6 wherein the first element forms a sleeve comprised of said cover, said bottom and said lateral sides, and the second element forms a box open only on the same side as said bottom of said first element when said elements are assembled and, on the opposite side, said plate forming a top portion of the box of said second element and having said passage between it and a transverse side wall of the box of said second element, said first and second elements being assembled by sliding the second element into the first element in a direction parallel to the lateral edges of said register box.

* * * * *